US010594035B2

(12) United States Patent
Buskgaard et al.

(10) Patent No.: US 10,594,035 B2
(45) Date of Patent: Mar. 17, 2020

(54) PROXIMITY SENSING ANTENNA

(71) Applicant: Silicon Laboratories Inc., Austin, TX (US)

(72) Inventors: Emil F. Buskgaard, Copenhagen (DK); Olfert P. Paulsen, Dragor (DK)

(73) Assignee: Silicon Laboratories Inc., Austin, TX (US)

( * ) Notice: Subject to any disclaimer, the term of this patent is extended or adjusted under 35 U.S.C. 154(b) by 0 days.

(21) Appl. No.: 16/021,227

(22) Filed: Jun. 28, 2018

(65) Prior Publication Data

US 2019/0006758 A1 Jan. 3, 2019

Related U.S. Application Data

(60) Provisional application No. 62/528,338, filed on Jul. 3, 2017.

(51) Int. Cl.

| | |
|---|---|
| ***H01Q 1/24*** | (2006.01) |
| ***H01Q 9/04*** | (2006.01) |
| ***H01Q 1/38*** | (2006.01) |
| ***H01Q 9/42*** | (2006.01) |
| ***G08B 13/08*** | (2006.01) |
| *G08B 13/24* | (2006.01) |

(52) U.S. Cl.

CPC ..... *H01Q 9/0421* (2013.01); *G08B 13/08* (2013.01); *H01Q 1/38* (2013.01); *H01Q 9/42* (2013.01); *G08B 13/2494* (2013.01)

(58) Field of Classification Search

CPC ..... H01Q 9/0421; H01Q 9/42; H01Q 1/38; G08B 13/08; G08B 13/2494

USPC ..... 343/702

See application file for complete search history.

(56) References Cited

U.S. PATENT DOCUMENTS

| | | | | |
|---|---|---|---|---|
| 5,517,206 | A * | 5/1996 | Boone | H01Q 1/3275 343/792.5 |
| 6,255,994 | B1 | 7/2001 | Saito | |
| 6,483,463 | B2 | 11/2002 | Kadambi et al. | |
| 6,930,640 | B2 | 8/2005 | Chung et al. | |
| 7,345,634 | B2 | 3/2008 | Ozkar et al. | |
| 7,495,629 | B2 | 2/2009 | Parsche et al. | |

(Continued)

OTHER PUBLICATIONS

Kervel, "868 MHz, 915 MHz and 955 MHz Inverted F Antenna", Texas Instruments, Design Note DNO23, 14 pgs. (2011).

*Primary Examiner* — Jean B Jeanglaude

(74) *Attorney, Agent, or Firm* — Egan Peterman Enders Huston

(57) ABSTRACT

Proximity sensing antenna systems include two metallic antenna arms. One antenna arm is connected to an RF transmitter at a radio frequency (RF) feed port, and the other antenna arm is connected to an RF detector (e.g., RF measurement receiver or RF power detector) at an RF sense port. The metallic antenna arms are symmetrically positioned with respect to each other across one or more symmetry axes. The metallic antenna arms can be implemented as inverted-L antennas, dipole antennas, inverted-F antennas, and/or as other antenna arm configurations. Further, the antenna arms can be dimensionally identical and positioned symmetrically about one or more symmetry axes. The antenna system can be used within proximity sensing devices for a wide variety of applications including low power sensing and can also be used for wireless data communication.

22 Claims, 8 Drawing Sheets

(56) References Cited

U.S. PATENT DOCUMENTS

| | | | | |
|---|---|---|---|---|
| 8,577,289 | B2 | 11/2013 | Schlub et al. | |
| 8,781,420 | B2 | 7/2014 | Schlub et al. | |
| 9,520,637 | B2 * | 12/2016 | Monte | H01Q 3/02 |
| 9,846,252 | B2 | 12/2017 | Yang et al. | |
| 9,966,648 | B2 * | 5/2018 | Liu | H01Q 3/02 |
| 2009/0143028 | A1 | 6/2009 | Kim | |
| 2012/0176289 | A1 * | 7/2012 | Lee | H01Q 9/285 343/818 |
| 2012/0190296 | A1 * | 7/2012 | Sarabandi | H01Q 1/525 455/7 |
| 2013/0300618 | A1 | 11/2013 | Yarga et al. | |
| 2014/0057576 | A1 * | 2/2014 | Monte | H01Q 3/02 455/73 |
| 2014/0139386 | A1 * | 5/2014 | Liu | H01Q 3/02 343/781 CA |

* cited by examiner

PROXIMITY SENSING ANTENNA

RELATED APPLICATIONS

This application claims priority to the following provisional application: U.S. Provisional Patent Application Ser. No. 62/528,338, filed Jul. 3, 2017, and entitled "PROXIMITY SENSING ANTENNA," which is hereby incorporated by reference in its entirety.

TECHNICAL FIELD

This disclosure is related to remote sensing of the environment, and more specifically to an antenna configuration that is sensitive to changes in the local environment.

BACKGROUND

Electronic proximity sensing is used in a great variety of applications including handheld telecommunication devices, alarm systems, and the like. Present proximity sensing devices vary greatly in their sensitivity to nearby objects, but are lacking in high-sensitivity capabilities, especially in simple low-power systems.

SUMMARY

Systems and related methods are disclosed for proximity sensing antennas. For disclosed embodiments, the antenna systems include two metallic antenna arms. One of the metallic antenna arms is connected to an RF transmitter at a radio frequency (RF) feed port, and the other metallic antenna arm is connected to an RF detector, such as an RF measurement receiver or RF power detector, at an RF sense port. The metallic antenna arms are also symmetrically positioned with respect to each other across one or more symmetry axes. The metallic antenna arms, for example, can be implemented as inverted-L antennas (ILAs), dipole antennas, inverted-F antennas (IFAs), and/or as other antenna arm configurations. For certain embodiments, the antenna arms are dimensionally identical and positioned symmetrically about a symmetry axis with the grounded end of the first metallic antenna arm and the grounded end of the second antenna arm mounted to the ground plane proximate to one another. For certain embodiments, the antenna system provides two inverted-F antennas coupled together and symmetrically positioned with respect to the symmetry axis. The antenna system can be used within proximity sensing devices for a wide variety of applications including low power battery operated sensing and can also be used for wireless data communication. Various features and embodiments can be implemented, and related systems and methods can be utilized, as well.

For one embodiment, a system is disclosed including a first metallic antenna arm connected to an RF transmitter at a radio frequency (RF) feed port and a second metallic antenna arm connected to an RF detector at a radio frequency (RF) sense port. Further, the first and second metallic antenna arms are symmetrically positioned with respect to each other across one or more symmetry axes.

In additional embodiments, the first and second metallic antenna arms are at least one of inverted-L antennas, dipole antennas, or inverted-F antennas. In further embodiments, the first and second metallic arms are dimensionally identical.

In additional embodiments, the first and second metallic antenna arms are inverted-F antennas; the RF feed port is connected at a first distance (d1) from a grounded end of the first metallic antenna; and the RF sense port is connected at a second distance (d2) from a grounded end of the second metallic antenna. In further embodiments, the grounded end of the first metallic antenna arm and the grounded end of the second antenna arm are mounted to a ground plane proximate to one another, and wherein the first distance (d1) is equal to the second distance (d2). In still further embodiments, the system also includes a grounding stub coupled to a ground plane, and the grounded end of the first metallic arm and the ground end of the second metallic arm are coupled to the grounding stub.

In additional embodiments, the first and second metallic antenna arms are inverted-F antennas and are folded such that a free end of the first metallic antenna arm is directed toward a free end of the second metallic antenna arm. In further embodiments, the free end of the first metallic antenna arm is proximate the free end of the second metallic antenna arm such that a distance between tips of the free ends of the first and second metallic antenna arms is less than half a length for each of the first and second metallic antenna arms. In still further embodiments, the first metallic antenna arm and the second metallic antenna arm are wrapped around a ground plane.

In additional embodiments, the system further includes an antenna controller with electrical connections to the feed port and the sense port and having antenna coupling characteristics as a measurement output. In further embodiments, when a high permittivity material is brought proximate to the first metallic antenna arm and second metallic antenna arm, a change is caused in the measurement output of the antenna coupling characteristics for the antenna controller measures. In still further embodiments, the change in the antenna coupling characteristics over frequency is at least one of a change in resonant frequency or a change in amplitude. In additional further embodiments, the antenna controller has an alarm indication output when the antenna controller measures a change in the antenna coupling characteristics.

In additional embodiments, the system also includes a network interface system including network interface electronics and a network antenna. In further embodiments, a directional coupler is not coupled to the feed port.

For one embodiments, a method is disclosed including transmitting a radio frequency (RF) signal using a first metallic antenna arm connected to an RF transmitter at an RF feed port, sensing an RF signal using a second metallic antenna arm connected to the an RF detector at an RF sense port, and outputting an antenna coupling characteristic based upon the sensing. Further, the first and second metallic antenna arms are symmetrically positioned with respect to each other across one or more symmetry axes, In additional embodiments, the first and second metallic antenna arms are at least one of inverted-L antennas, dipole antennas, or inverted-F antennas. In further embodiments, the first and second metallic antenna arms are dimensionally identical.

In additional embodiments, the method also includes using a change in the antenna coupling characteristics to indicate a change in proximity of an object to the first and second metallic arms. In further embodiments, the method also includes generating an alarm indication output based upon the change in proximity of the object.

In additional embodiments, the method also includes using a change in the antenna coupling characteristics to indicate two or more different positions for an object with respect to the first and second metallic arms.

In additional embodiments, the method also includes communicating with one or more external network devices based upon a change in the antenna coupling characteristics.

Different or additional features, variations, and embodiments can be implemented, if desired, and related systems and methods can be utilized, as well.

DESCRIPTION OF THE DRAWINGS

It is noted that the appended drawings illustrate only example embodiments of the invention and are, therefore, not to be considered limiting of its scope, for the invention may admit to other equally effective embodiments.

DETAILED DESCRIPTION

Systems and related methods are disclosed for proximity sensing utilizing a high-sensitivity proximity sensing antennas. For certain embodiments, the antenna system provides two inverted-F antennas coupled together and symmetrically positioned with respect to a symmetry axis. For certain embodiments, the antenna system provides two inverted-L antennas or dipole antennas that are symmetrically positioned across one or more symmetry axes. Other antenna configurations can also be implemented. The antenna system can be used within proximity sensing devices for a wide variety of applications including low power battery operation and/or other applications. Other features and variations can be implemented for the embodiments described herein, and related systems and methods can be utilized, as well.

Figure 1A:
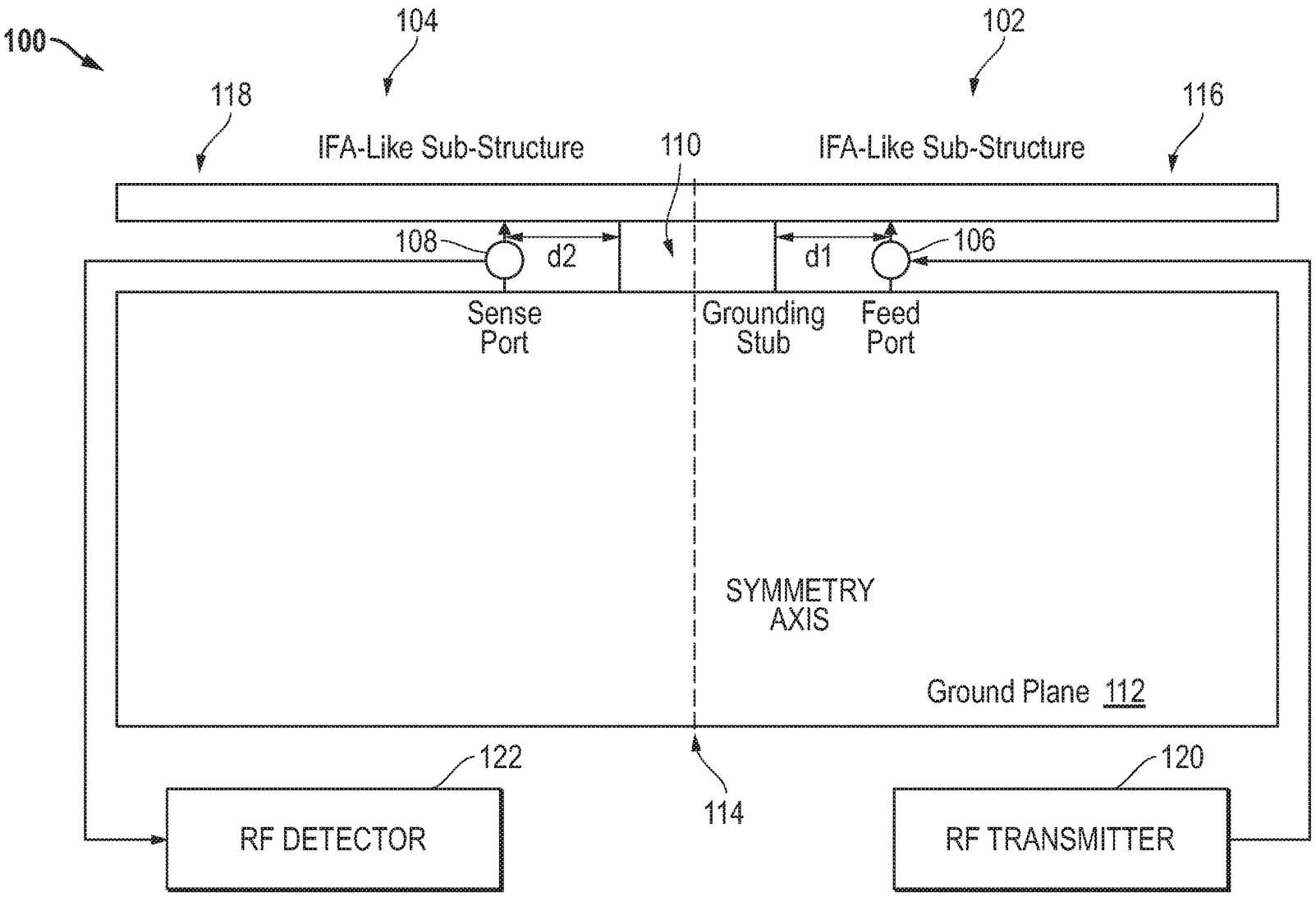
FIG. 1A is a diagram of example embodiment for a proximity sensing antenna including a pair of metallic antenna arms, preferably implemented as a pair of symmetrical inverted-F antennas (IFA).

FIG. 1A is a diagram of example embodiment for a proximity sensing antenna 100 including a pair of metallic antenna arms 116/118. In a preferred embodiment, the configuration of the antenna system resembles a pair of identical inverted-F antennas (IFA) mounted back-to-back or side-by-side along a symmetry axis 114. More particularly, FIG. 1A illustrates an example configuration of the proximity sensing antenna 100 with one IFA-like sub-component 102 acting as a transmitter with a feed port 106 and the other IFA-like sub-component 104 acting as a sensing-receiver with a sense port 108. Each of the IFA-like sub-components 102/104 has a metallic antenna arm 116/118 that is connected to a common ground plane 112 through a grounding stub 110. Although shown as a common ground stub 110, the sub-components 102/104 can also be connected to the common ground plane 112 through different grounding stubs. The feed port 106 is connected a first distance (d1) from the grounding stub 110 between the metallic antenna arm 116 and the ground plane 112. The feed port 106 is also connected to a radio frequency (RF) transmitter 120 that is configured to transmit RF signals across an operational range for the proximity sensing antenna 100. The sense port 108 is connected a second distance (d2) from the grounding stub 110 between the metallic antenna arm 118 and the ground plane 112. The sense port 108 is also coupled to an RF detector 122 that is configured to sense RF signals across an operational range for the proximity sensing antenna 100. For one embodiment, the first distance (d1) and the second distance (d2) are the same. It is further noted that the impedance for the feed port 106 can be controlled by adjusting the first distance (d1) for the connection of the feed port 106 from the grounding stub 110. Similarly, the impedance for the sense port 108 can be controlled by adjusting the second distance (d2) for the connection of the sense port 108 from the grounding stub 110. The composite antenna structure for embodiment 100, as well as other embodiments disclosed herein, exhibits very high coupling between the two antenna arms 116 and 118 at the matched frequencies and a very well defined drop in coupling at lower frequencies.

Figure 1B:
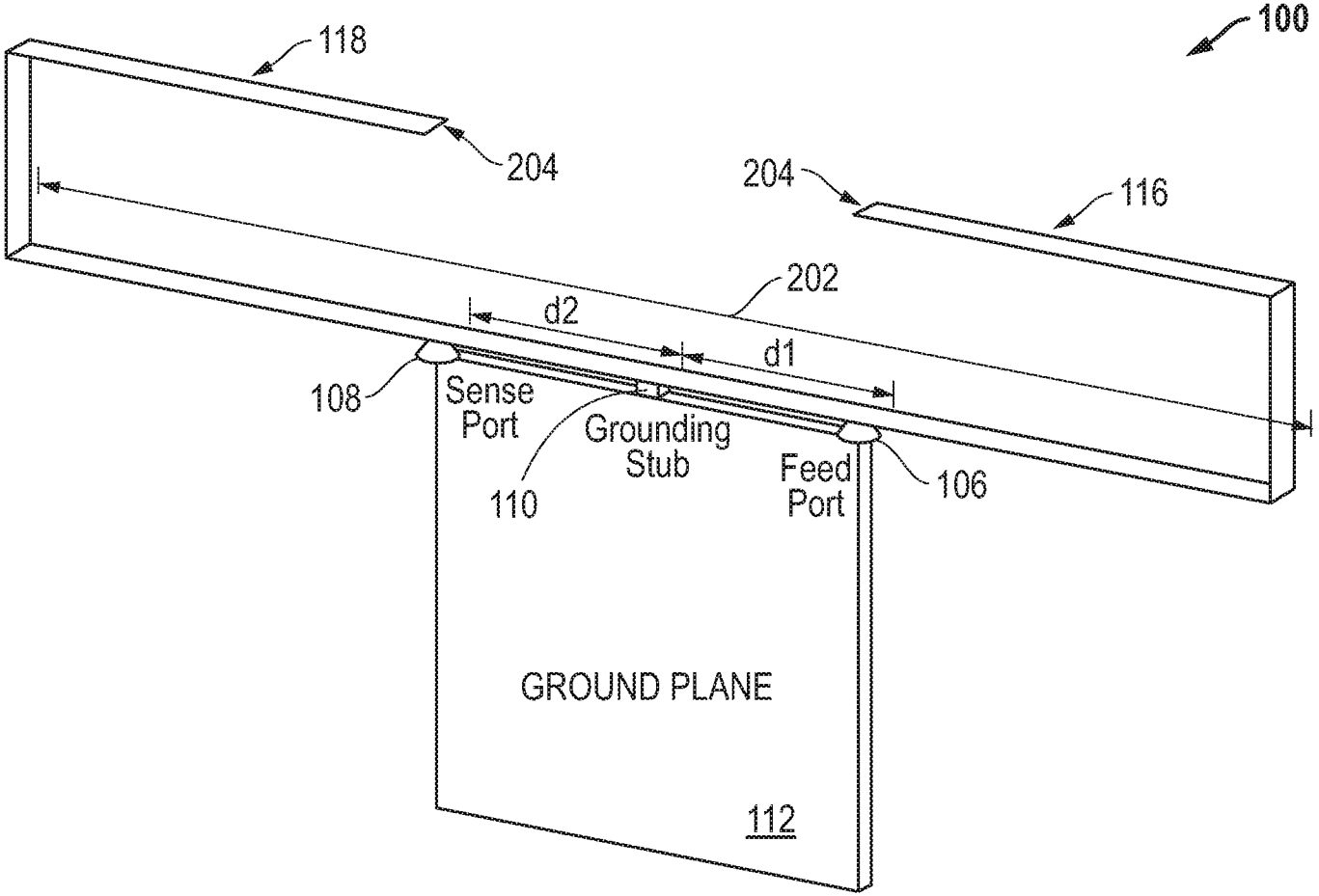
FIG. 1B illustrates an example embodiment of the proximity sensing antenna where the antenna arms are folded over and where the tips of the antennas are brought close to one another.

FIG. 1B illustrates an example embodiment of the proximity sensing antenna 100 where the antenna arms 116/118 are folded over, and where the tips 204 of the antennas are brought close to one another. For example, the antenna tips 204 can be positioned such that the distance between them is less than half the length for each of the antenna arms 116/118. This has the advantage of increasing the capacitance between the two arms as well as saving space. For one example embodiment depicted, the horizontal width 202 for the antenna structure can be 6 centimeters (cm), and the antenna tips 204 can be 2 cm apart. In an alternate configuration, the antenna arms 116/118 are wrapped around the ground plane 112, which further reduces the space taken by the proximity sensing antenna 100.

For the embodiments disclosed herein, the two antenna arms or sub-structures are preferably identical, thus creating a matched, highly coupled antenna pair. This balance creates a strong coupling in a selected frequency range (e.g., the resonant frequency range). Strong coupling, as used herein, indicates at least one of: (1) for certain frequency ranges, the impedance exhibited by the antenna arms is closely matched; (2) the coupling exhibited by the antenna arms is stronger than −3 dB; (3) the coupling exhibited by the antenna arms is stronger than −0.5 dB; and/or (4) the coupling exhibited by the antenna arms has greater than a selected difference value between a first frequency range and a second frequency range, where the selected difference value is at least 10 dB, at least 5 dB, or a sufficient difference value to distinguish the first frequency range from the second frequency range. In certain embodiments, a selected difference value includes a change in coupling strength such as a selected dB change within a selected frequency difference, and/or a change in a coupling strength characteristic, such as a rapid increase or decrease in coupling (e.g., a slope of the unloaded switch-point line, a value of a differential such as d(dB)/d(f), and/or time averaged or filtered values thereof). In certain embodiments, the first frequency range is a high frequency range and the second frequency range is a low frequency range, and in certain further embodiments the first frequency range and the second frequency range are separated by at least 300 MHz and/or by at least 50 MHz.

In addition, the two-port configuration of the disclosed embodiments eliminates the need for a directional coupler, which is eliminated due to the separation of the feed port from the sense port. For example, a traditional single IFA transmitting antenna system would sense the reflection of RF power back into the feed port, which would require a directional coupler. In contrast, for the example embodiment 100, no directional coupler is required. In embodiments, the disclosed sensing antenna configurations may include a plurality of antenna sub-components (e.g., IFA-like sub-components), such as comprising multiple sets of antenna sub-components, a third sensing arm, and the like. In certain embodiments, the antenna (e.g. IFA-like) sub-components may not be physically identical to one another, such as where the antenna (e.g., IFA-like) sub-components are matched through matching circuitry and/or varied geometry exhibiting the selected impedance responses. Other variations can also be implemented while still taking advantage of the techniques described herein.

Figure 2A:
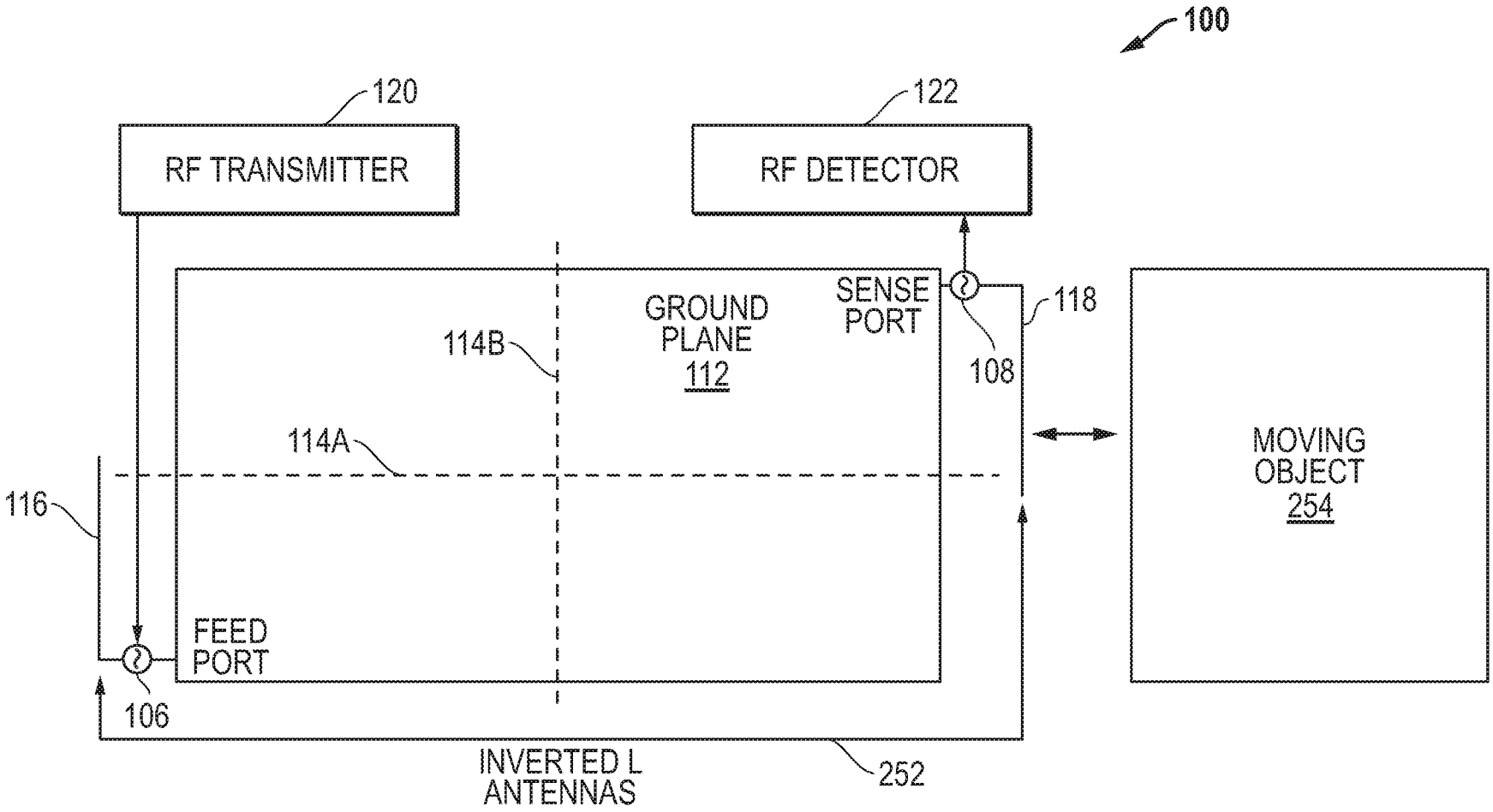
FIG. 2A illustrates an example embodiment for the proximity sensing antenna where the antenna arms are implemented as inverted-L antennas and are not coupled to a grounding stub.

FIG. 2A illustrates an example embodiment for the proximity sensing antenna 100 where the metallic antenna arms 116/118 are not coupled to a grounding stub. For this embodiment, the antenna arms 116/118 are implemented as two monopole antennas mounted on opposite corners of a ground plane 112, and the antenna arms 116/118 still have strong coupling as described herein without having grounded ends. In particular, the metallic antenna arms 116/118 are implemented as inverted-L antennas (ILAs). Further, for the embodiment depicted, the metallic arms 116/118 are symmetrically positioned with respect to each other across two axes of symmetry 114A/114B associated with the ground plane 112. The antenna arm 116 has a free end and a second end connected to the feed port 106 that is also coupled to the ground plane 112, and the second antenna arm 118 has a free end and a second end connected to the sense port 108 that is also coupled to the ground plane 112. As described above, the RF transmitter 120 is coupled to the feed port 106, and the RF detector 122 (e.g., measurement receiver or power detector) is coupled to the sense port 108. The strong coupling between the two metallic arms 116/118 allows for detection of a moving object 254, as described herein, due to changes in the coupling as the moving object 254 comes close to the proximity sensing antenna 100. For the embodiment depicted, the ILA antenna 118 is effectively rotated around the center of the ground plane 112 with respect to the other ILA antenna 116. As such, the fields traveling on the ground plane will go from one antenna to the other providing strong coupling between antennas 116/118.

For traditional antenna applications, strong coupling between antenna arms is normally unwanted coupling that causes the antenna patterns of the two antennas to be very similar. For example, if using such an antenna configuration in a MIMO (multiple-input-multiple-output) mobile handset device, this configuration would provide poor performance as both antennas would transmit or receive with high correlation thereby causing the signals on both antennas to be very similar. As such, two different MIMO streams could not be separated. In contrast, the embodiment disclosed herein provide for and use strong coupling between the antenna arms for proximity detection. As long as the antenna systems described herein are far away from object disturbances (e.g., unloaded state), the antennas are strongly coupled and transmission from one antenna to the other is strong. However, when the antenna system is disturbed by an external object (e.g., loaded state), the signal on the sensing antenna arm 118 changes, and these changes can be used for proximity detection. As such, the embodiments disclosed herein take advantage of strong coupling between transmitting/sensing antenna arms 116/118 that would be undesirable for traditional antenna applications.

Figure 2B:
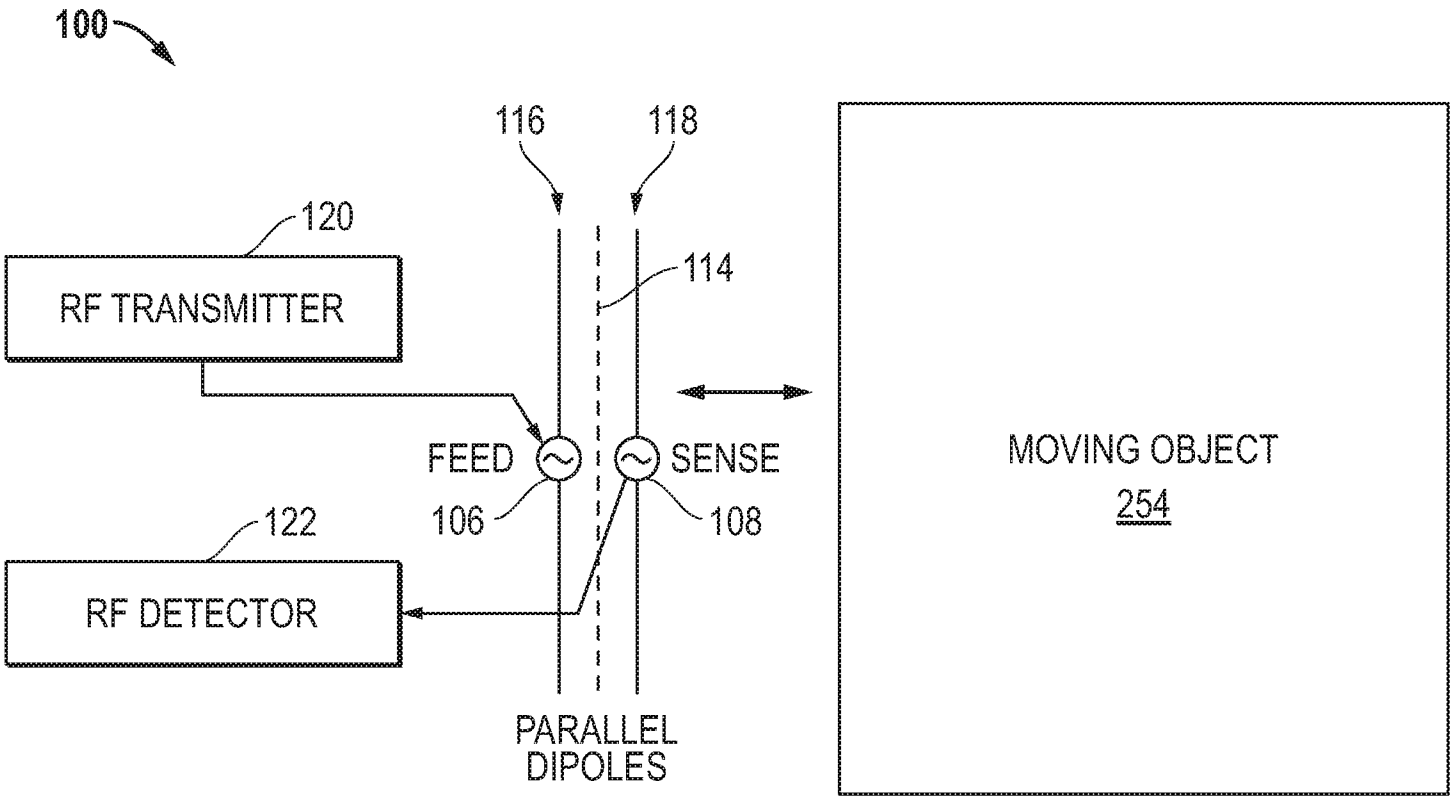
FIG. 2B illustrates an example embodiment for the proximity sensing antenna where the antenna arms are implemented as dipole antennas.

FIG. 2B illustrates an example embodiment for the proximity sensing antenna 100 where the metallic antenna arms 116/118 are implemented as dipole antennas. For this embodiment, the metallic antenna arms 116/118 still have strong coupling as described herein without being coupled to a ground plane. In particular, the metallic antenna arms 116/118 are implemented as parallel dipole antennas with the feed/sense ports 106/108 differentially coupled between two equal length antenna segments. Further, for the embodiment depicted, the metallic arms 116/118 are symmetrically positioned with respect to each other across a symmetry axis 114. The strong coupling between the two metallic arms 116/118 allows for detection of a moving object 254, as described herein, due to changes in the coupling as the moving object 254 comes close to the proximity sensing antenna 100. For the embodiment depicted, one dipole antenna 116 connected to the RF transmitter 120 through the feed port 106, and the other dipole antenna 118 is connected to the RF detector 122 (e.g., measurement receiver or power detector) through the sense port 108. The antennas are closely spaced, parallel and matched to the same frequency in the unloaded state. They will then be closely coupled in the unloaded state. When the antennas are mismatched by a moving object 254 coming near to the antenna system 100, the coupling will be decreased as described herein so that the proximity of the moving object 254 is detected.

Figure 3:
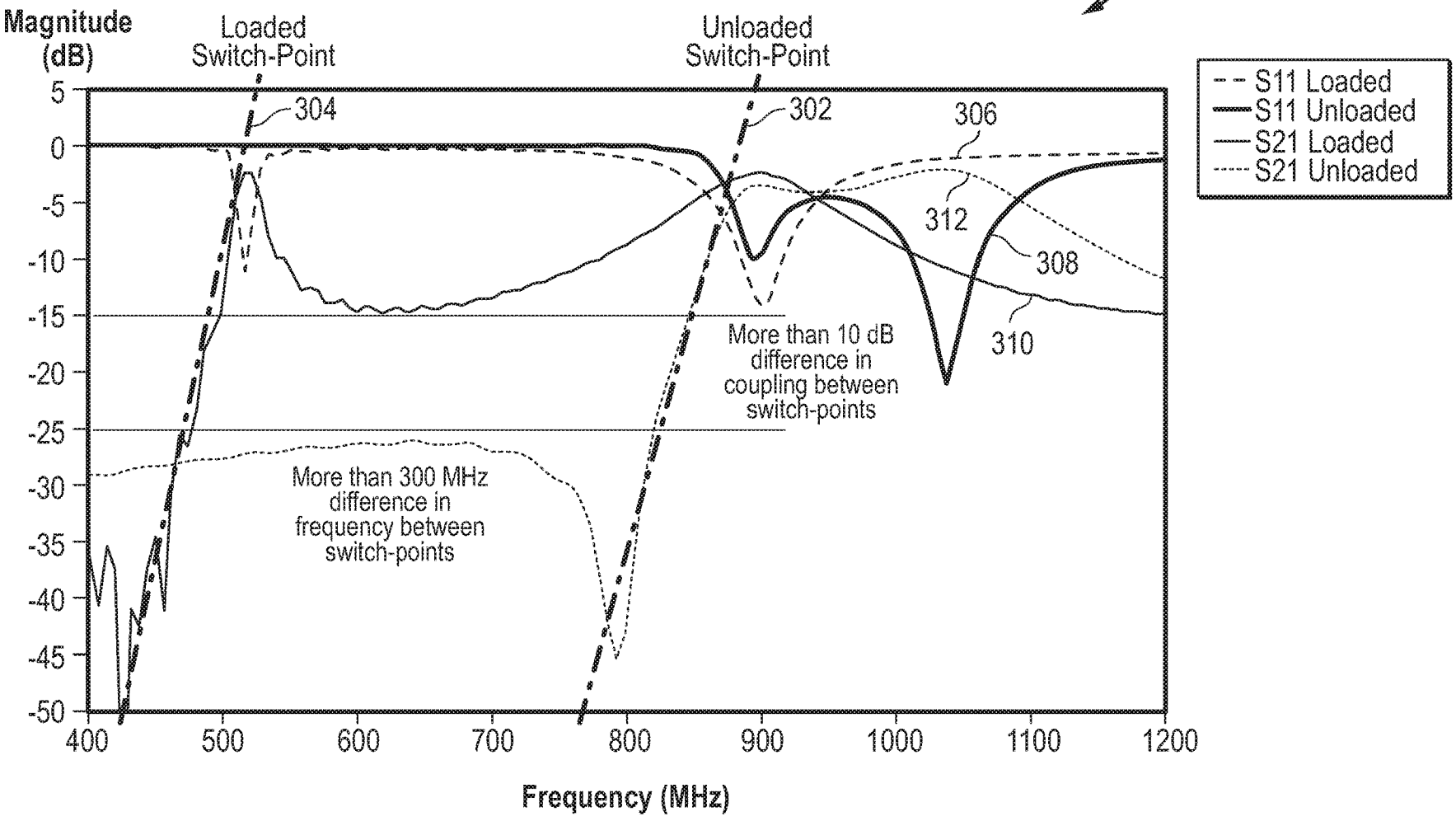
FIG. 3 shows an example embodiment for a simulation of the frequency and amplitude response for the antenna configuration shown in FIG. 1B.

FIG. 3 shows an example embodiment 300 for a simulation of the frequency and amplitude response for the antenna configuration shown in FIG. 1B. The balanced system creates a strong coupling in the resonant frequency range that enables the structure to be very sensitive to changes in the near environment. When an object, such as a metal or high-permittivity material, is brought close, the matching of the antenna system changes in frequency leading to a change in the coupling. This change in antenna coupling characteristics then leads to a change in amplitude at a given frequency. This can be seen on the "unloaded" curves 308/312 in FIG. 3, where the "unloaded" switch-point 302 marks the steep flank between the high-coupling region and the low-coupling region in an unloaded condition (e.g., when no object is near the antenna). When the high E-field region of the antennas (e.g., close to the tips in FIG. 1B illustration) is loaded by a conductive or high-permittivity material the resonance frequency will drop due to a detuning of the system from the unloaded condition. This drop is seen on the "loaded" curves 306/310, which drops down to the "loaded" switch-point 304. In this simulation, a metal plate was placed approximately 1 millimeter (mm) away from the antenna tips 204 in FIG. 1B, resulting in a considerable drop in resonance frequency. In this case, the steep flank is shifted from the "unloaded" switch-point 302 to the "loaded" switch-point 304, representing a shift of more than 300 MHz (corresponding to a 37.5%) frequency change. In addition, the amplitude drops more than 10 dB between the switch-points in the example.

It is noted that curves 306/308 labelled S11 represent reflections and that curves 310/312 labelled S21 represent coupling. More particularly, the S11 lines 306/308 show where the transmitting part of the proximity sensing antenna is matched. The dip in these curves around 800-900 MHz shows the resonance frequency. The S21 lines 310/312 show the actual coupling (e.g., how much power is picked up at the sense port due to the power applied at the feed port). These S21 lines 310/312 are significant in that they are the ones showing what the antenna system is actually sensing. As can be seen on the S21 lines 310/312, the coupling is considerably stronger above the resonance frequency than below.

It is noted that the proximity sensing antenna 100 is highly sensitive to external disturbances. In addition, the proximity sensing antenna 100, which provides a strong coupling in the resonant frequency range, provides for a very low loss system. The proximity sensing antenna 100 can thus be excited by a much weaker signal that requires a much lower current consumption and produces less spurious emissions. In the simulated case illustrated in FIG. 3, the coupling is demonstrated to be stronger than −3 dB, and for other simulated cases coupling stronger than −0.5 dB has been observed.

It is further noted that the proximity sensing antenna 100 is simple to construct and match. For example, with respect to the embodiment of FIGS. 1A-B, the antenna system 100 is essentially constructed of two IFA elements. The distances (d1/d2) from the grounding stub 110 to the feed port 106 and from the grounding stub 110 to the sense port 108 determine the impedance of the antenna and can be adjusted to form desired impedances.

With the proximity sensing antenna's 100 capability to sense the presence of nearby objects, the proximity sensing antenna 100 may be employed in various applications, such as in handheld devices, security devices, vehicle parking applications, conveyor systems, automatic faucets, and the like, where the proximity sensing antenna 100 provides a highly sensitive low-power solution to proximity detection.

Figure 4:
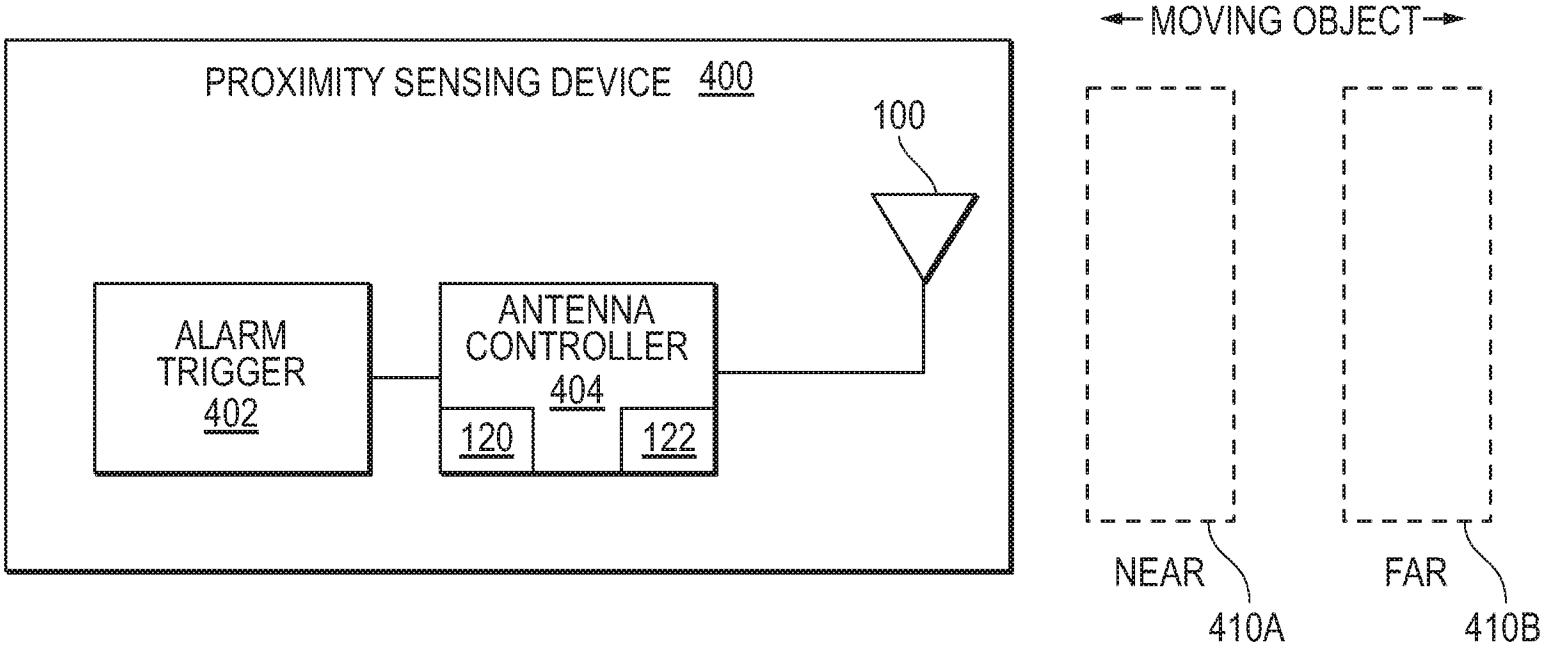
FIG. 4 is an example embodiment for a proximity sensing device including a proximity sensing antenna as described herein and an antenna controller.

As one example, the proximity sensing antenna 100 can be integrated into a proximity sensing device 400, such as illustrated in FIG. 4, where the proximity sensing antenna 100 (including a sensing portion 104 and a transmit portion 102) is interfaced with an antenna controller 404 comprising electronic circuitries. The antenna controller 404 in part includes the RF transmitter 120 and the RF detector 122 along with other electronic circuits and components. The antenna controller 404 operates to control the operational state of the proximity sensing antenna 100 and to control sensing by the sensing portion 104 of a change in antenna coupling characteristics that indicates the proximity of an object. The antenna controller 404 has the antenna coupling characteristics as a measurement output that can be used for a variety of purposes. For example, the antenna controller 404 may interface with an alarm system 402. The alarm system 402 can operate to sound an audible or visual alarm, to transmit a proximity indication to another device, and/or to initiate other desired actions. For example, the alarm controller 404 may provide an operating state to the proximity sensing antenna 100 in a sensing mode, and detect an object moving from position 410B to a position 410A near the proximity sensing antenna 100. The antenna controller 404 may then detect a change in antenna coupling characteristics through the sensing portion 104 of the proximity sensing antenna 100 that indicates the proximity of the object and send a signal to the alarm system 402.

The proximity sensing device 400 may also provide for a system configuration for detection associated with a movable object in a variety of applications. For instance, the proximity sensing device 400 may be used in the open-close detection of building doors and windows (e.g., a window that opens, a door, a cabinet door, and the like), such as in an automated home system.

Figure 5:
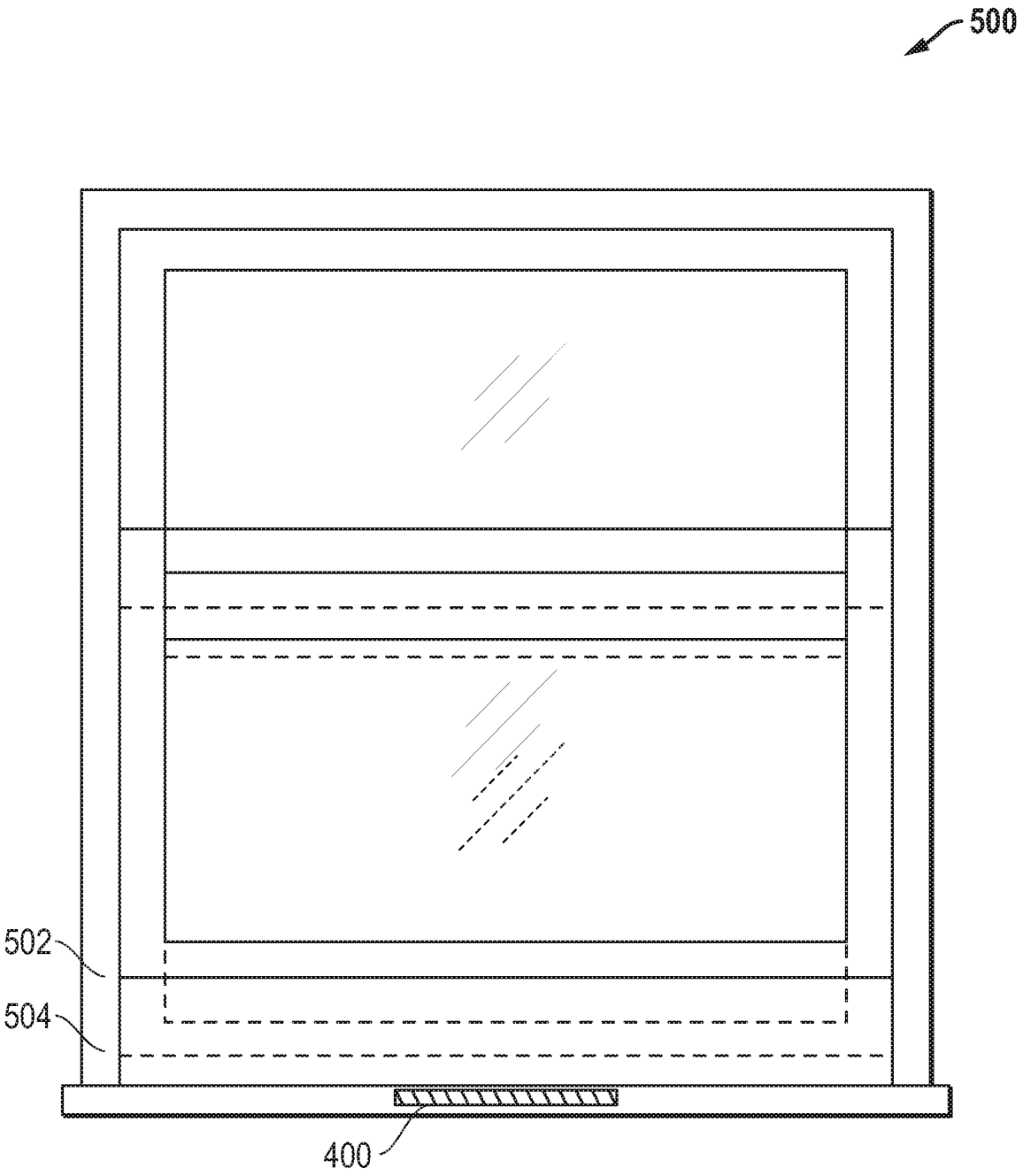
FIG. 5 illustrates an example embodiment of an application for the proximity sensing device installed with respect to a window environment detection configuration.

FIG. 5 illustrates a non-limiting example embodiment of a window environment detection configuration. For this embodiment, a proximity sensing device 400 installed at a single point along the frame of the window 500 with a movable pane that is movable to at least a first position 502 (e.g., an open window position) and a second position 504 (e.g., a further closed window position). In this configuration, the proximity sensing device 400 detects the window frame as it is lowered from position 502 to 504. Further, the proximity sensing device 400 may be programmed to detect intermediate positions of the window slider, such as for detecting a first state representing the open window condition (e.g., an unloaded antenna state), a second state representing an almost closed condition (e.g., a partially loaded antenna state), a third state representing a closed-locked condition (e.g., a loaded antenna state), and the like. This non-limiting example of a window detection system with three states may enable the system to detect the three window positions of (1) open, (2) mostly closed but not locked, and (3) closed and locked. More generally, the large shift in frequency response for proximity sensing device 400 between an unloaded and loaded condition may enable the system to be configured to detect a plurality of different proximity conditions depending upon the application (e.g., different distances, different materials, an animate (e.g., human hand) verses inanimate object (e.g., window slider), and the like.

Figure 6:
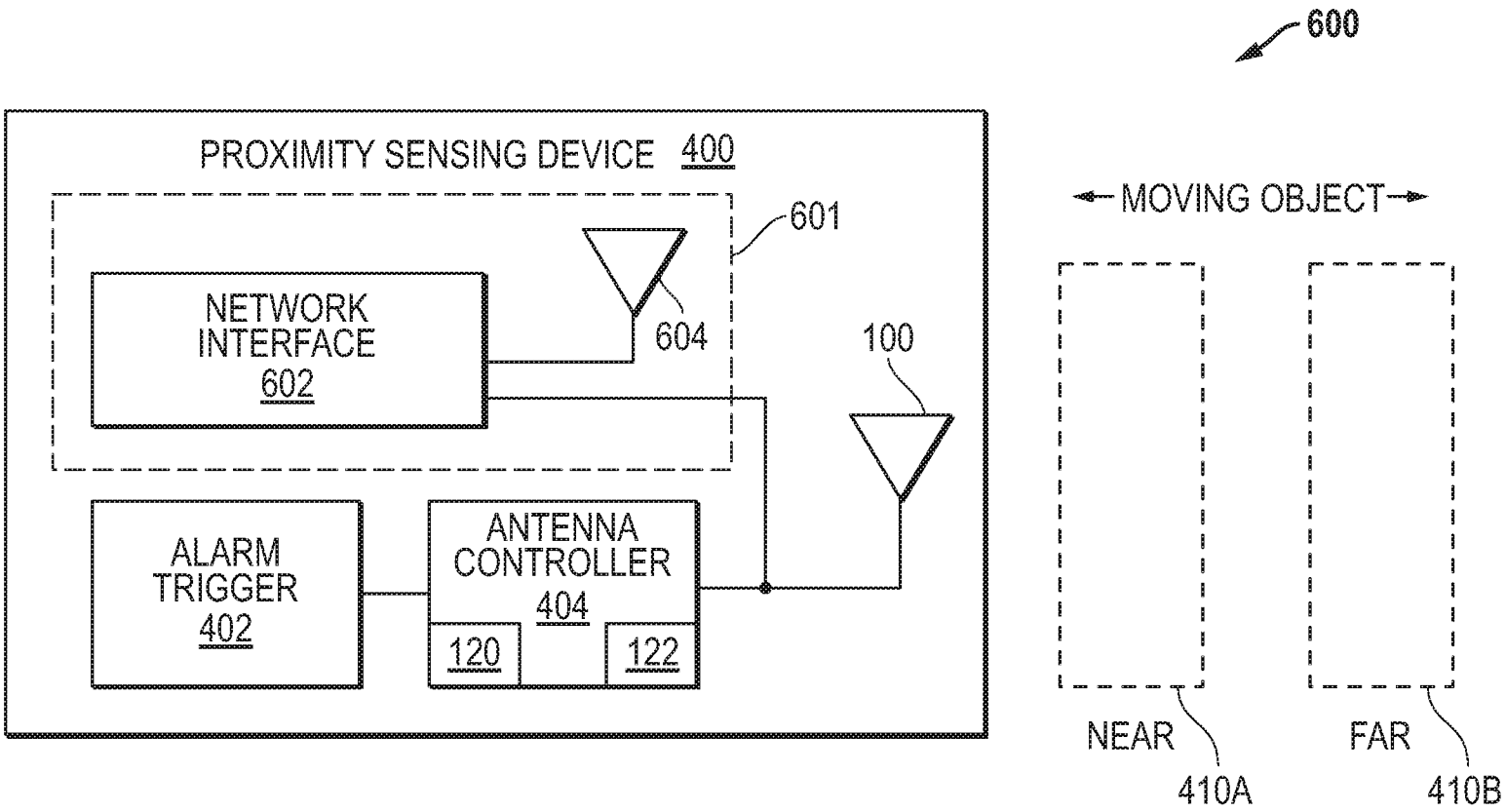
FIG. 6 illustrates an example embodiment for the proximity sensing device including a network interface system configured to communicate with one or more networks, such as a mesh network.

In some embodiments, such as shown for embodiment 600 in FIG. 6, the proximity sensing device 400 may include a network interface system 601 configured to communicate with one or more networks. For the embodiment 600, the network interface system 601 includes network interface electronics 602 and a network antenna 604. For certain embodiments, the proximity sensing antenna 100 is used by the network interface system 601 instead of or in addition to the network antenna 604. For embodiments where no separate network antenna 604 is used, the proximity sensing antenna 100 is shared by the antenna controller 404 and the network interface 602.

For one embodiment, the proximity sensing device 400 may be a network node in a network comprising a plurality of network nodes (e.g., as part of a building security system). For certain embodiments, the proximity sensing device 400 may transmit an alarm indication message to a second network node of the plurality of network nodes when the proximity sensing device detects the proximity of an object. The alarm indication message may be relayed through the network to a network controller, wherein the network controller transmits an alarm indication. For instance, the alarm indication may be a wireless alarm indication to a networked mobile user device across a wireless network (e.g., a WiFi network, cellular communications network, and the like). For one example embodiment, the proximity sensing device 400 includes a low power mode and an alarm mode. The proximity sensing device 400 operates in the low power mode until a proximity indication is detected, upon which the proximity sensing device 400 enters an alarm mode and transmits an alarm indication message across a network (e.g., a secure network).

In some embodiments, the proximity sensing device 400 is a node in a mesh network and operates as port of the mesh network routing capability that enables an interconnection of all the nodes in the network. For example, each mesh network node may transform any stand-alone device into an intelligent networked device (e.g., sensor, actuator, controller, repeater, and the like) that can be controlled and monitored wirelessly. Further, the intelligence that the network device connects to may be integrated with the network node or may be in a separate physical or virtual device wirelessly or otherwise interconnected with the node. For instance, a functionally integrated network device may be an automatic lighting device where the network node is integrated with an automatic lighting controller, enabling the network node to act as an end-point controller-monitor of the controlled automatic lighting device as well as acting as a network node for fulfilling routing capacities of nodes in the network. In another instance, a network node may wirelessly communicate with an external node that may or may not be connected to the rest of the mesh network. For example, a network node may connect wirelessly with a stand-alone proximity sensing device 400 that acts to perform a monitoring and alert function where the alert is communicated to the network node for further relay through the mesh network.

Further, the network may enable the proximity sensing device 400 to utilize the features and capabilities of the mesh network and associated components. For example, in multi-speed mesh networks, the proximity sensing device 400 can utilize mesh network features and capabilities such as using a static update controller, silent acknowledge, node repair, battery powered node functionality, energy savings systems, and the like. For further examples, the proximity sensing device 400 may act as a low power device that is normally in a sleep mode but which monitors an input communications channel for a preamble that indicates that the proximity sensing device 400 should wake or stay awake to receive a message. The network interface of the proximity sensing device 400 may allow for relay of functionality to other mesh network nodes, act as a mesh network node in a silent acknowledgement procedure, and the like. In further embodiments, the proximity sensing device 400 may act as a mesh network node amongst a plurality of mesh network nodes, and the proximity sensing device 400 can be controlled through a central controller, controlled by a user mobile device, controlled through a cellular interface controller for remote user control, and the like.

It is noted that the functional blocks, components, devices, and/or circuitry described herein can be implemented using hardware, software, or a combination of hardware and software. For example, the disclosed embodiments can be implemented using electronic circuitry programmed to perform the functions, tasks, methods, actions, and/or other operational features described herein for the disclosed embodiments. The electronic circuitry can include, for example, one or more processors and/or configurable logic devices (CLDs). The one or more processors can be, for example, one or more central processing units (CPUs), controllers, microcontrollers, microprocessors, hardware accelerators, and/or other processing devices. The one or more CLDs can be, for example, one or more CPLDs (complex programmable logic devices), FPGAs (field programmable gate arrays), PLAs (programmable logic array), ASICs (application specific integrated circuit), reconfigurable logic circuits, and/or other logic devices. Further, the electronic circuitry, including the one or more processors, can also be programmed to execute software, firmware, code, and/or other program instructions that are embodied in one or more non-transitory tangible computer-readable mediums to perform the functions, tasks, methods, actions, and/or other operational features described herein for the disclosed embodiments. The electronic circuitry, including the one or more CLDs, can also be programmed using logic code, logic definitions, hardware description languages, configuration files, and/or other logic instructions that are embodied in one or more non-transitory tangible computer-readable mediums to perform the functions, tasks, methods, actions, and/or other operational features described herein for the disclosed embodiments. In addition, the one or more non-transitory tangible computer-readable mediums can include, for example, one or more data storage devices, memory devices, flash memories, random access memories, read only memories, programmable memory devices, reprogrammable storage devices, hard drives, floppy disks, DVDs, CD-ROMs, and/or any other non-transitory tangible computer-readable mediums. Other variations can also be implemented while still taking advantage of the techniques described herein.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. A system, comprising:

a first metallic antenna arm connected to an RF transmitter at a radio frequency (RF) feed port; and a second metallic antenna arm connected to an RF detector at a radio frequency (RF) sense port;

wherein the first and second metallic antenna arms are symmetrically positioned with respect to each other across one or more symmetry axes.

2. The system of claim 1, wherein the first and second metallic antenna arms are at least one of inverted-L antennas, dipole antennas, or inverted-F antennas.

3. The system of claim 1, wherein the first and second metallic arms are dimensionally identical.

4. The system of claim 1, wherein the first and second metallic antenna arms are inverted-F antennas, wherein the RF feed port is connected at a first distance (d1) from a grounded end of the first metallic antenna, and wherein the RF sense port is connected at a second distance (d2) from a grounded end of the second metallic antenna.

5. The system of claim 4, wherein the grounded end of the first metallic antenna arm and the grounded end of the second antenna arm are mounted to a ground plane proximate to one another, and wherein the first distance (d1) is equal to the second distance (d2).

6. The system of claim 4, further comprising a grounding stub coupled to a ground plane, and wherein the grounded end of the first metallic arm and the ground end of the second metallic arm are coupled to the grounding stub.

7. The system of claim 1, wherein the first and second metallic antenna arms are inverted-F antennas and are folded such that a free end of the first metallic antenna arm is directed toward a free end of the second metallic antenna arm.

8. The system of claim 7, wherein the free end of the first metallic antenna arm is proximate the free end of the second metallic antenna arm such that a distance between tips of the free ends of the first and second metallic antenna arms is less than half a length for each of the first and second metallic antenna arms.

9. The system of claim 7, wherein the first metallic antenna arm and the second metallic antenna arm are wrapped around a ground plane.

10. The system of claim 1, further comprising an antenna controller with electrical connections to the feed port and the sense port and having antenna coupling characteristics as a measurement output.

11. The system of claim 10, wherein when a high permittivity material is brought proximate to the first metallic antenna arm and second metallic antenna arm, a change is caused in the measurement output of the antenna coupling characteristics for the antenna controller measures.

12. The system of claim 11, wherein the change in the antenna coupling characteristics over frequency is at least one of a change in resonant frequency or a change in amplitude.

13. The system of claim 11, wherein the antenna controller has an alarm indication output when the antenna controller measures a change in the antenna coupling characteristics.

14. The system of claim 10, further comprising a network interface system including network interface electronics and a network antenna.

15. The system of claim 10, wherein a directional coupler is not coupled to the feed port.

16. A method, comprising:

transmitting a radio frequency (RF) signal using a first metallic antenna arm connected to an RF transmitter at an RF feed port;

sensing an RF signal using a second metallic antenna arm connected to the an RF detector at an RF sense port; and outputting an antenna coupling characteristic based upon the sensing;

wherein the first and second metallic antenna arms are symmetrically positioned with respect to each other across one or more symmetry axes.

17. The method of claim 16, wherein the first and second metallic antenna arms are at least one of inverted-L antennas, dipole antennas, or inverted-F antennas.

18. The method of claim 16, wherein the first and second metallic antenna arms are dimensionally identical.

19. The method of claim 16, further comprising using a change in the antenna coupling characteristics to indicate a change in proximity of an object to the first and second metallic arms.

20. The method of claim 19, further comprising generating an alarm indication output based upon the change in proximity of the object.

21. The method of claim 16, further comprising using a change in the antenna coupling characteristics to indicate two or more different positions for an object with respect to the first and second metallic arms.

22. The method of claim 16, further comprising communicating with one or more external network devices based upon a change in the antenna coupling characteristics.

* * * * *